US009022640B2

(12) United States Patent
Floyd et al.

(10) Patent No.: US 9,022,640 B2
(45) Date of Patent: May 5, 2015

(54) STIRRING APPARATUS FOR REDUCING VORTEXES

(75) Inventors: Karen Floyd, Spartanburg, SC (US); Angel Cox, Lyman, SC (US); Tom Wilke, Greenville, SC (US)

(73) Assignee: TPG Universal II, LLC, Spartanburg, SC (US)

( * ) Notice: Subject to any disclaimer, the term of this patent is extended or adjusted under 35 U.S.C. 154(b) by 25 days.

(21) Appl. No.: 13/479,431

(22) Filed: May 24, 2012

(65) Prior Publication Data

US 2013/0135962 A1 May 30, 2013

Related U.S. Application Data

(60) Provisional application No. 61/489,321, filed on May 24, 2011.

(51) Int. Cl.

| | |
|---|---|
| ***B01F 7/18*** | (2006.01) |
| ***B01F 7/00*** | (2006.01) |
| ***B01F 13/00*** | (2006.01) |

(52) U.S. Cl.

CPC ..... *B01F 7/00291* (2013.01); *B01F 7/00341* (2013.01); *B01F 7/00641* (2013.01); *B01F 13/0028* (2013.01); *B01F 2215/005* (2013.01); *B01F 2215/0422* (2013.01); *B01F 2215/0431* (2013.01)

(58) Field of Classification Search

CPC ..... B01F 3/00; B01F 3/08; B01F 3/0853; B01F 7/00; B01F 7/00008; B01F 7/00016; B01F 7/00091; B01F 7/001; B01F 7/00108; B01F 7/00141; B01F 7/00233; B01F 7/00291; B01F 7/00583; B01F 7/00566; B01F 2215/00; B01F 2215/04; B01F 2215/0413; B01F 2215/0418; B01F 2215/0431

USPC ..... 366/279, 325.7–325.91, 325.94, 366/325.4–325.5, 328.1, 129, 342–343

See application file for complete search history.

(56) References Cited

U.S. PATENT DOCUMENTS

| | | | | | |
|---|---|---|---|---|---|
| 642,535 | A | * | 1/1900 | Snyder | 165/109.1 |
| 647,273 | A | * | 4/1900 | Mendenhall | 74/665 K |
| 906,934 | A | * | 12/1908 | Rightmyer | 366/312 |
| 1,109,979 | A | * | 9/1914 | Ford | 106/222 |
| 1,716,363 | A | * | 6/1929 | Brooks | 366/307 |
| 2,138,607 | A | * | 11/1938 | Larsen | 165/118 |
| 2,240,841 | A | * | 5/1941 | Flynn | 241/98 |
| 3,166,303 | A | * | 1/1965 | Chapman | 366/129 |
| 3,337,191 | A | * | 8/1967 | Gall | 366/325.4 |
| 4,844,355 | A | * | 7/1989 | Kemp et al. | 241/172 |
| 4,924,444 | A | * | 5/1990 | Castellanos | 366/343 |
| 5,460,447 | A | * | 10/1995 | Wu et al. | 366/279 |
| 5,470,148 | A | * | 11/1995 | Gorr et al. | 366/64 |
| 5,676,463 | A | * | 10/1997 | Larsen | 366/251 |
| 6,068,395 | A | * | 5/2000 | Ondracek | 366/129 |

(Continued)

*Primary Examiner* — Charles Cooley

(74) *Attorney, Agent, or Firm* — McNair Law Firm, P.A.; Douglas W. Kim

(57) ABSTRACT

This invention is directed to a stirring apparatus comprising: a plurality of blades having between a 5° to 180° twist along the length of their axis attached perpendicularly to a shaft so that a downward fluid flow is created when the shaft is rotated by a rotary drive; and, a plurality of standards attached to the plurality of blades separating the plurality of blades and arranged parallel to the shaft and rotated between 0° and 25° relative to a plane defined by the blades and the standards so that an inward fluid flow is created when the shaft is rotated and a bottom blade connected to the standards.

18 Claims, 8 Drawing Sheets

(56) References Cited

U.S. PATENT DOCUMENTS

| | | | | |
|---|---|---|---|---|
| 6,712,499 | B2 * | 3/2004 | Fink, Jr. | 366/325.5 |
| 7,422,363 | B2 * | 9/2008 | Parker | 366/325.4 |
| 8,905,622 | B2 * | 12/2014 | Anderson et al. | 366/325.8 |
| 2003/0067836 | A1 * | 4/2003 | Clifford Fink, Jr. | 366/65 |
| 2006/0187744 | A1 * | 8/2006 | Parker | 366/129 |
| 2012/0051173 | A1 * | 3/2012 | Galloway | 366/129 |
| 2013/0135962 | A1 * | 5/2013 | Floyd et al. | 366/279 |

* cited by examiner

STIRRING APPARATUS FOR REDUCING VORTEXES

CLAIM OF PRIORITY

This application claims priority on U.S. provisional patent application Ser. No. 61/489,321.

BACKGROUND OF THE INVENTION

1) Field of the Invention

The present invention relates to a mixing or stirring apparatus which reduces the vortex and increases the efficiency of the mixing process.

2) Description of Related Art

Many substances require mixing prior to use, such as paint. Paint is comprised of pigment, a vehicle or solvent, a binder and sometimes additives. These components tend to separate when the paint is stationary for some period and time and should be mixed prior to use. Mixing is also desired for other substances such as grout, mortar or other ingredients which do not naturally mix but need to be formed into an emulsion. Further, mixing to equilibrium is desired since it results in a mixing solution being less apt to separate into its original ingredients. Mixing of these sorts is desired in pharmaceuticals, paper, food preparation, cosmetics, and paint.

There have been many attempts to produce a suitable mixer for material such as paint, however, these attempts include undesirable aspects such as incomplete mixing, the undesirable creation of a vortex, and a very specific use of the mixer to achieve desirable results. For example, U.S. Pat. No. 2,879,044 discloses a paint mixing tool which includes a shank and a disk portion having spaced projections. This device includes inherent disadvantages. For example, when this device is improperly oriented in a container, a vortex is created (FIG. 7A) where the vortex 200 caused by the flow created by stirrer 204 results in particles 202 collecting at the bottom of the can, resulting in undesirable mixing. FIG. 7A shows the stirrer placed in an offset position and approximately 90° in relation to the surface of the substance to be mixed. In use, most individuals are unaware that this is the most undesirable orientation of a mixer in a container to achieve proper mixing, and specific knowledge about the mix is needed to effectively mix the substance. Further, the creation of a vortex places hydraulic stress on the shank and shortens the lifespan of the shaft and mixer.

One consequence of improperly using such a mixer is that when the user realizes that the pigment of paint is not mixing thoroughly, the user tends to increase the rotational speed of the mixer. This does not improve mixing, but rather requires more power and places greater stress on the shank. In one study, a 50% increase in rotational speed required 3 times more power to rotate the shank. However, the lack of a vortex indicates more efficient mixing and does not indicate that rotational speed should be increased. Determining proper mixing from viewing the surface of a substance to be mixed, such as paint which is opaque, can result in improper actions by the user which can lead to wasted energy without realization of mixing effectiveness.

Referring to FIG. 7B, the mixer is angled approximately 10° from vertical which results in a reduction of the vortex. Further, the mixer is placed approximately a distance of about ¼ to ⅓ diameter of the mixing container away from the edge of the container. However, this design, while an improvement, requires the specific orientation of the mixing shank to be 10° off center and placed ¼ to ⅓ of the length of the diameter of the mixing container form the side.

Further, the orientation of the mixer relative to the central axis 204 of the mixing container affects the effectiveness of the mixing. Optimally, the mixer is placed in a 15° offset to the central axis in the rotational direction 210 of the mixer as shown as 206 in FIG. 7C. This offset results in random collisions of the particles to be mixed and a more thorough mixing of the substance in the mixing chamber. When the mixer is parallel to the central axis of the mixing chamber as shown by 208, a vortex is created with all the disadvantages described above. When the mixer is placed in a 15° offset in the counter-rotational direction shown as 210, there is a swirling effect created in the substance to be mixed and the particles do not mix as uniformly. Therefore, there is a need for a mixing device that can be used with a rotary drive, such as a drill, which does not require such a specific orientation for maximizing effectiveness.

One attempt to overcome the disadvantages of the mixer creating a vortex is the use of tank baffles as illustrated in U.S. Pat. No. 4,150,900. The baffle can be located within the tank substantially at or just below the liquid surface. These baffles are spaced about the tank wall, and for a constant level agitated tank can be secured to the wall at a fixed location. It is suggested that a plurality of baffles should be used to increase the effectiveness of the agitator. However, the use of baffles increases the costs and risks damage to the mixer if the rotating mixer comes into contact with the baffles. This is particularly disadvantageous for paint mixing since paint is opaque and the physical location of the baffles generally cannot be seen by the user.

Another attempt to effectively mix materials such as paint is shown in U.S. Pat. No. 5,676,463 having a mixing paddle 212 (FIG. 7D) with a planar orientation. This design, when rotated, causes the flat surface 214 of the mixing blade to experience resistance as the surface area of the flat surface contacts the substance to be mixed (i.e., paint). Therefore, stress is placed on the mixing blade limiting the rotation speed and therefore the efficiency of the design. Further, when the paddle moves in a direction shown as 216, the movement of the flat surface of the mixing paddle through the paint creates a vacuum 218 on the trailing side 220 of the blade due to the flow of the paint 222 around the blade. This design does not efficiently mix paint at the rotational speed and therefore efficiency is limited by the design itself.

Further, these designs are prone to cause bubbles to form in the mixture, an undesirable results in paint, concrete and other substances that require mixing. There is a need for an efficient mixing apparatus which does not create bubbles or cause cavitations in the substance to be mixed.

Accordingly, it is an object of the present invention to provide an improved stirring apparatus that can be used to efficiently and effectively mix fluids and materials without creating a vortex in the substance to be mixed.

It is another object of the present invention to provide an improved stirring apparatus that can be operated without overly specific or complicated operating instructions.

It is another object of the present invention to provide an improved stirring apparatus that avoids shortening the operational life through improper use.

SUMMARY OF THE INVENTION

The above objectives are accomplished according to the present invention by providing a stirring apparatus comprising: a plurality of blades having between a 5° to 180° twist along the length of their axis attached perpendicularly to a shaft so that a downward fluid flow is created when the shaft is rotated by a rotary drive; and, a plurality of standards attached to the plurality of blades separating the plurality of blades and arranged parallel to the shaft and rotated between 0° and 25° relative to a plane defined by the blades and the standards so that an inward fluid flow is created when the shaft is rotated.

The blades have a twist of about 60° and can have a serrated edge along a leading edge of at least one standard and a serrated edge along a trailing edge of at least one standard. A mixing vessel can be included for receiving the blades, the standards and a portion of the shaft; and, the length of the blades can be at least 50% of the diameter of the mixing vessel or greater than 80% of the diameter of the mixing vessel.

The stirring apparatus can include a shaft for attaching to a rotary drive; a first top blade having between 5° and 90° positive twist attached to the shaft generally perpendicular to the shaft; a second top blade having between 5° and 90° negative twist attached to the shaft and 180° to the first top blade; a first standard carried by a distal end of the first top blade having between a 0° to 25° positive offset to an axis defined along the length of the first top blade; a second standard carried by a distal end of the second top blade; and, a bottom blade attached to the first and the second standards.

The bottom blade has between a 0° to 90° twist along its length. An internal cavity can be defined by the first and second top blade, the first and second standards, and the bottom blade wherein the internal cavity includes a height to width ratio of 25:20 and spans a distance at least 80% the diameter of a mixing container receiving the apparatus. The length of the first top blade and the second top blade totals about 80% of the diameter of a mixing container receiving the apparatus.

The invention can further include an agitation cavity defined by a top blade having between a 30° and 90° twist along its length, a first and second standard attached to the top blade having an inside offset of between 0° and 25°; and, a mixing vessel receiving the agitation cavity so that when the shaft is rotated, a downward fluid flow and an inward fluid flow is provided. The standard can have an inside offset of about 15°.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

It will be understood by those skilled in the art that one or more aspects of this invention can meet certain objectives, while one or more other aspects can meet certain other objectives. Each objective may not apply equally, in all its respects, to every aspect of this invention. As such, the preceding objectives can be viewed in the alternative with respect to any one aspect of this invention. These and other objectives and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objectives, features, benefits and advantages of the present invention will be apparent from this summary and certain embodiments described below, and will be readily apparent to those skilled in the art. Such objectives, features, benefits and advantages will be apparent from the above in conjunction with the accompanying examples, data, figures and all reasonable inferences to be drawn therefrom, alone or with consideration of the references incorporated herein.

Figure 1:
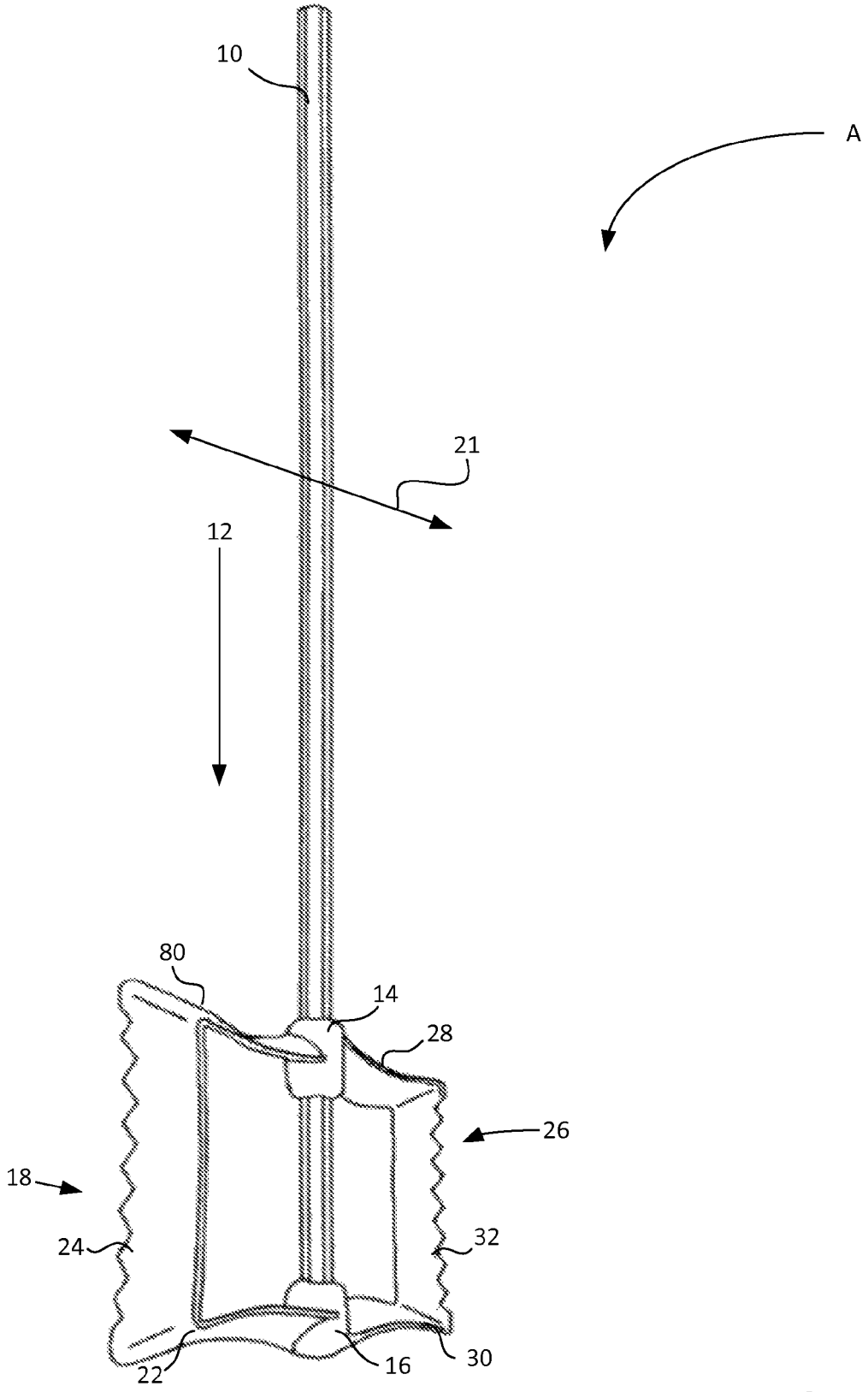
FIG. 1 shows a perspective view of the invention.

With reference to the drawings, the invention will now be described in more detail. Referring now to FIG. 1, the invention, which is generally shown as A, comprises a shaft 10 that is adapted to be received by a rotational drive such as a drill and a mixing head shown generally as 12, that is attached to a lower distal end of the shaft.

The mixing head 12 can include a top coupling 14 and a bottom coupling 16, both of which can be attached to the shaft. In one embodiment, the top coupling 14 and bottom coupling 16 are removably attached to the shaft. In another embodiment, the couplings are integrally connected to the shaft. The mixing head 12 also can also include a first top blade 20 attached to the top coupling and a second top blade attached to the coupling. In one embodiment, the first top blade and second top blade are attached to the shaft.

In one embodiment, the first top blade includes a twist in the range of about 5° to 180° relative to an axis 21 defined by the first and second top blade; generally perpendicular to the shaft. In one embodiment, the first top blade includes about a 30° twist. In one embodiment, the second top blade includes a twist in the range of about 15° to 45° relative to axis 21. In one embodiment, the second top blade includes about a 30° twist.

The proximal end 19 (FIG. 3) of the first blade adjacent to the shaft can be generally perpendicular to the shaft as can be proximal end 23 of the second top blade. In one embodiment, the first top blade is about 8 cm in length and the second top blade is about 8 cm in length. In one embodiment, the first top blade and second top blade form a top blade having a length of at least 80% the diameter of a mixing container receiving the invention.

In one embodiment, the first top blade and the second top blade are connected forming a top blade having between a 30° to 90° twist along its length. In one embodiment, the first top blade and the second top blade at connected forming a top blade having a 60° twist along its length.

A first standard 18 can be connected to the first top blade at the distal end of the first top blade. Referring to FIG. 3, first standard can include a 90° recess 40 along a leading edge 42 or trailing edge 44. The first standard can include a plurality of points 46 (FIG. 2) along a leading edge 42 or trailing edge 44. In one embodiment, the height $D^1$ of the first top blade is about 1 cm and the width of the first top blade is about 2.25 cm. The first standard can have a counter clockwise offset 50 relative to the rotation direction from parallel to a plane 48

Figure 4:
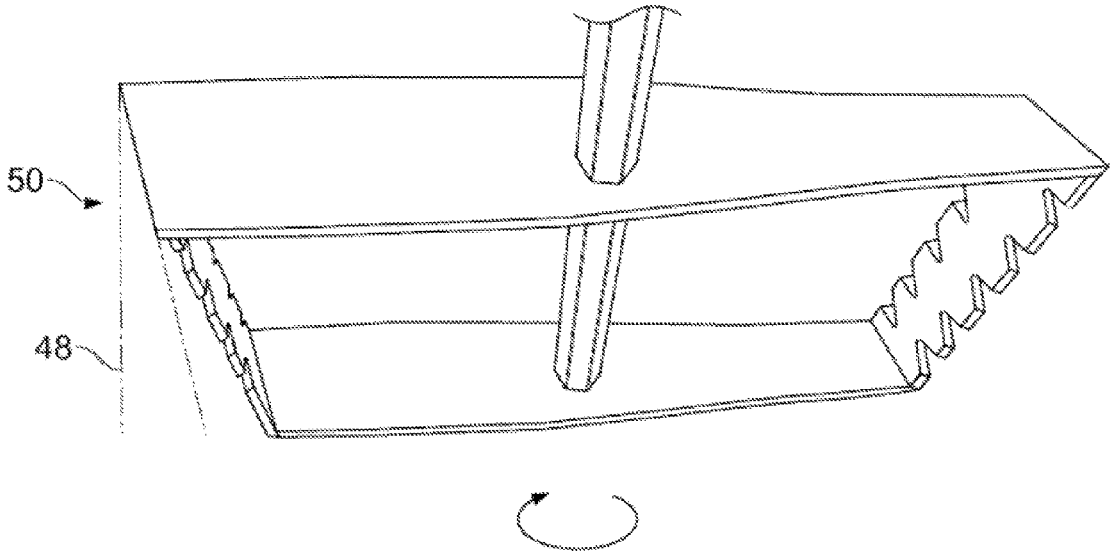
FIG. 4 shows a top perspective view of the invention.

(FIG. 4) defined by said first top blade and said standard. In one embodiment, the offset is between 5° and 25°. In another embodiment, the offset is 15° in a counter clockwise direction relative to the rotational direction.

A second standard 26 can be attached to the second top blade arranged to mirror the first standard. In one embodiment, the leading edge of said first and second standard includes serrations. In one embodiment, the trailing edge of the first and second standard includes serrations. In one embodiment and as shown in FIG. 1, the leading edge can have a length greater than the length of the trailing edge.

A second bottom blade 30 can be included attached to the shaft and the second standard. In one embodiment, the first bottom blade includes a twist in the range of about 15° to 45° relative to an axis 21 defined by the first and second top blade; generally perpendicular to the shaft. In one embodiment, the first bottom blade includes about a 30° twist. In one embodiment, the second bottom blade includes a twist in the range of about 15° to 45° relative to axis 21. In one embodiment, the second bottom blade includes about a 30° twist.

Figure 2:
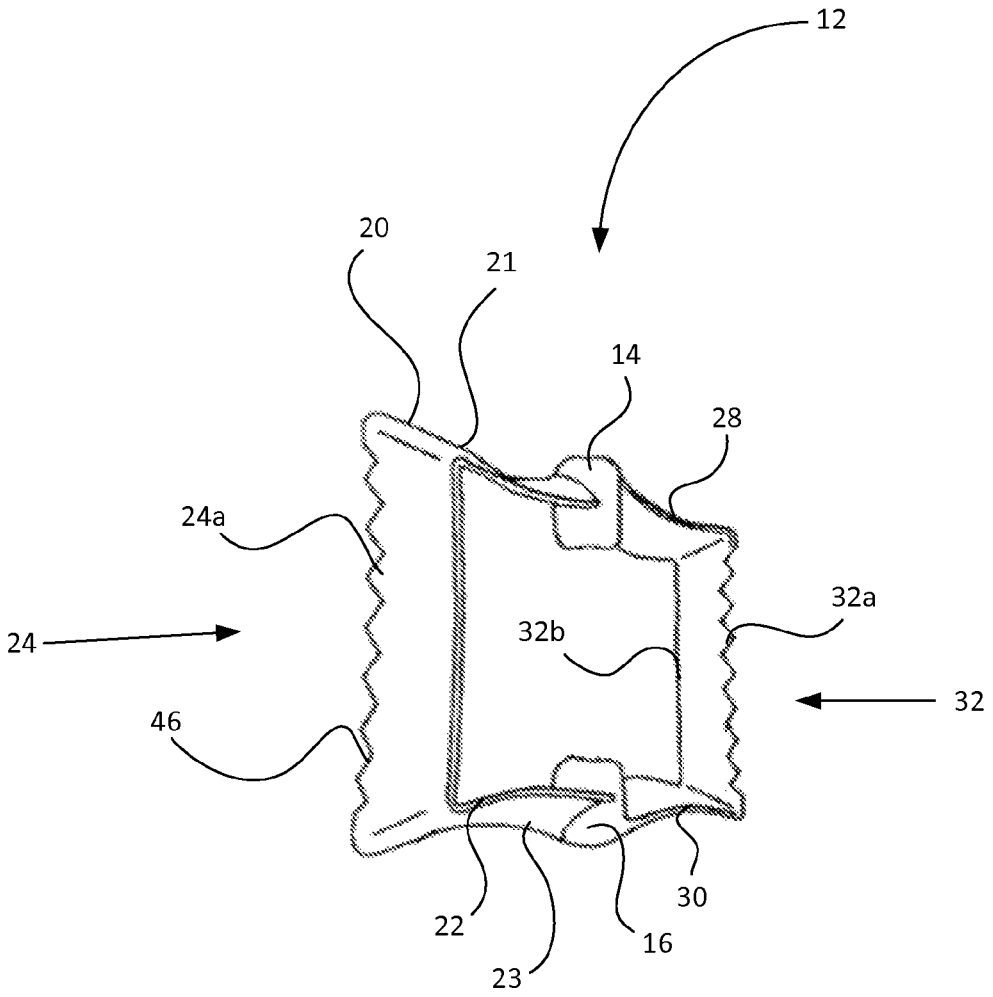
FIG. 2 shows a perspective view of the stirring apparatus of the invention.
Figure 3:
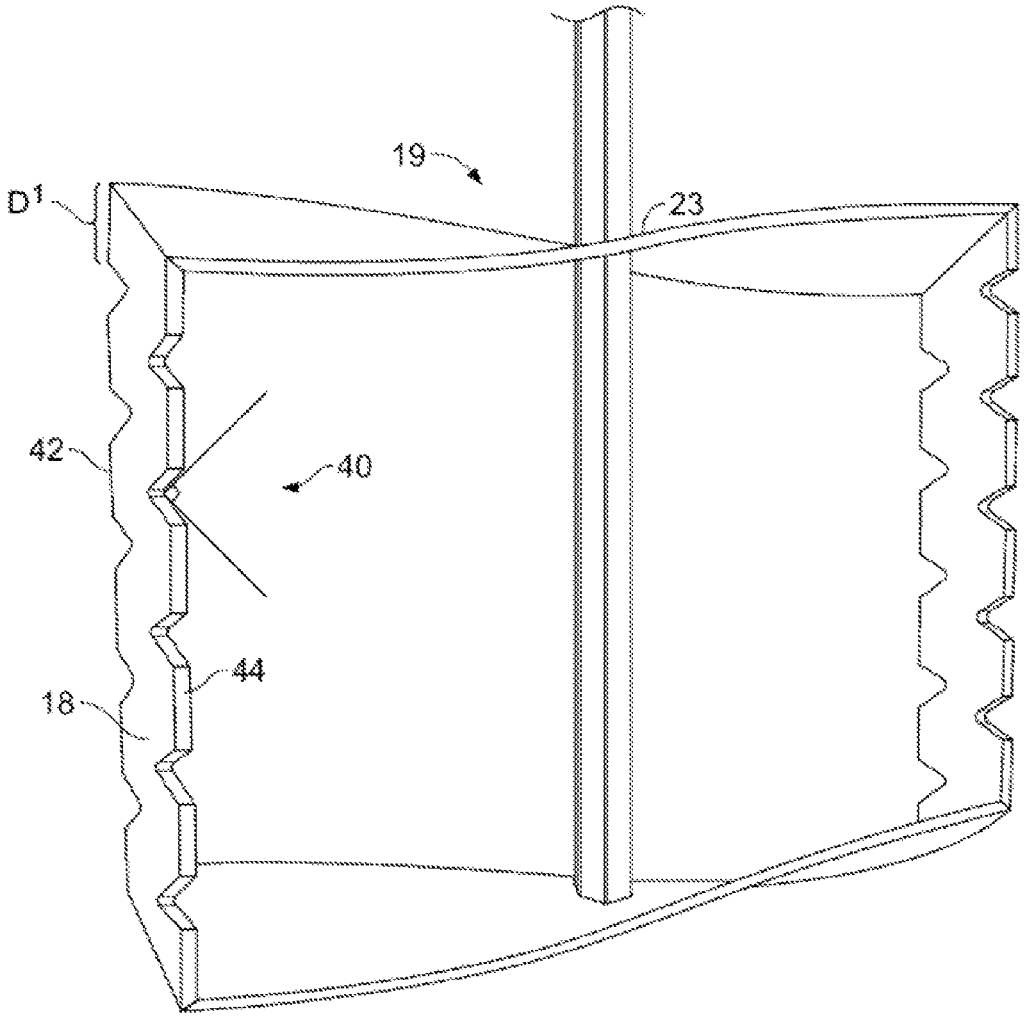
FIG. 3 shows a front view of the invention.

Referring now to FIG. 2, another embodiment is shown. The first top blade can have a concave surface 21 that extends outwardly from the top coupling such that said first top blade has a generally rearward angled relation to said top coupling 14. The first bottom blade 22 has a convex surface 23 that extends generally outwardly from said bottom coupling 16 such that said lower left arm 22 has a forwardly angled relation to said bottom coupling 16.

In one embodiment, the outwardly angled relation of the first standard 24 and the second standard 32 in relation to couplings 14 and 16, and therefore the shaft 12, provide a fluid motion so that when the stirring apparatus 12 is rotated in a clockwise direction, the fluids and/or materials being stirred are directed towards the shaft 10. The opposite angled relation of the first bottom blade 22 and second bottom blade 30 with respect to the bottom coupling 16 provide a fluid motion that is similar to the type that would be created by a hub of an airplane prop to force the fluids and/or materials in a direction that is parallel to the shaft. When rotated clockwise, the first bottom blade 22 and second bottom blade 30 create a lower pressure area over the outer surface, thereby creating a vacuum which enhances the stirring of a fluid and/or materials being mixed.

Figure 5:
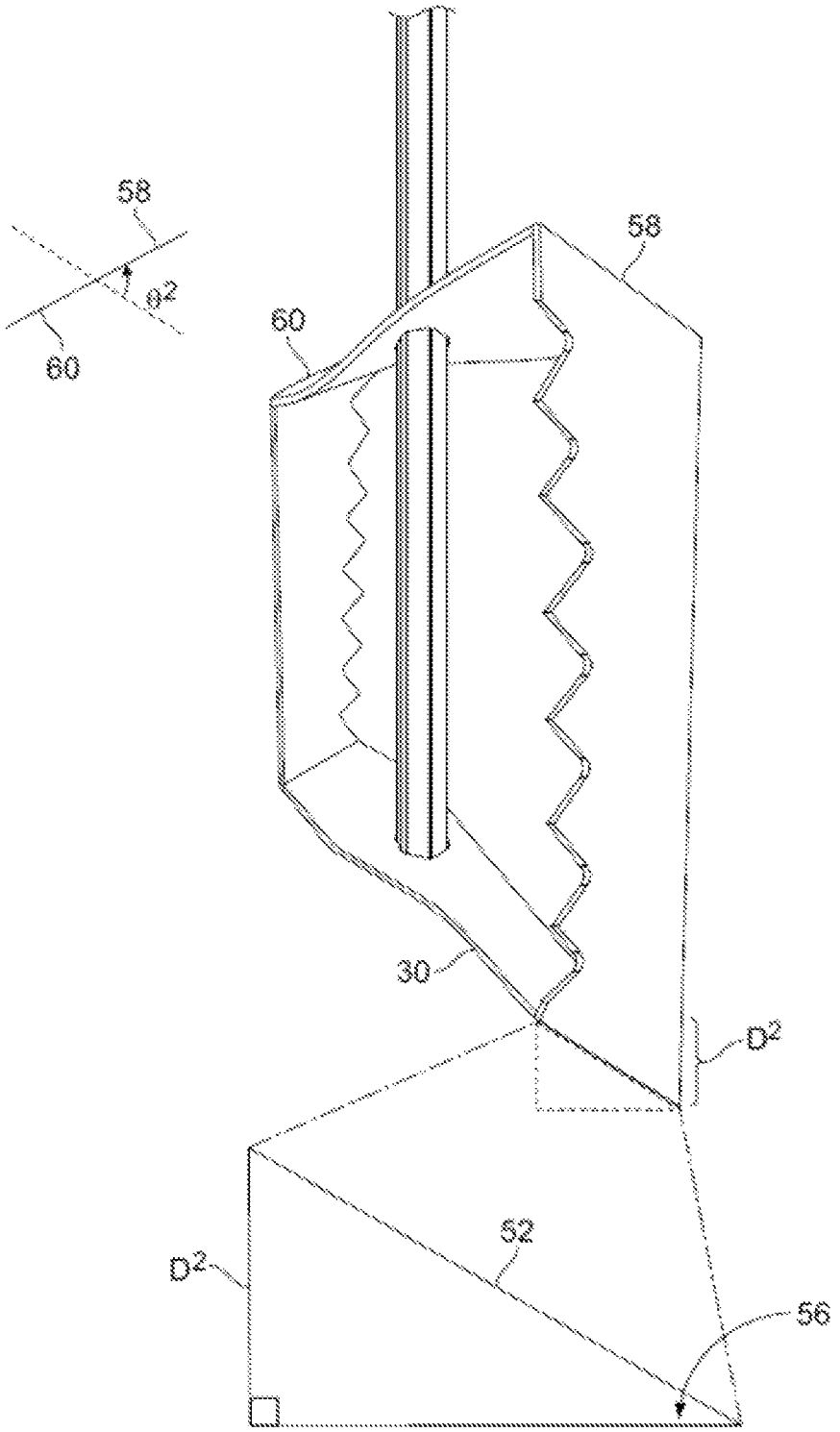
FIG. 5 shows a side perspective view of the invention.

Referring to FIG. 5, another embodiment is shown. The second bottom blade 30 is shown having a height $D^2$ The width of the second bottom blade 52, right angle 54, and angle 56 can be determined. In one embodiment, angle 56 is 30°. In one embodiment, angle 56 is between 0° and 90°. Further, the distal end of the second top blade is represented as 58 and the distal end of the first top blade is shown as 60. These two end define a twist angle $\theta^2$. In one embodiment, $\theta^2$ is about 60° and in another embodiment, $\theta^2$ is between 5° and 180°.

Figure 6:
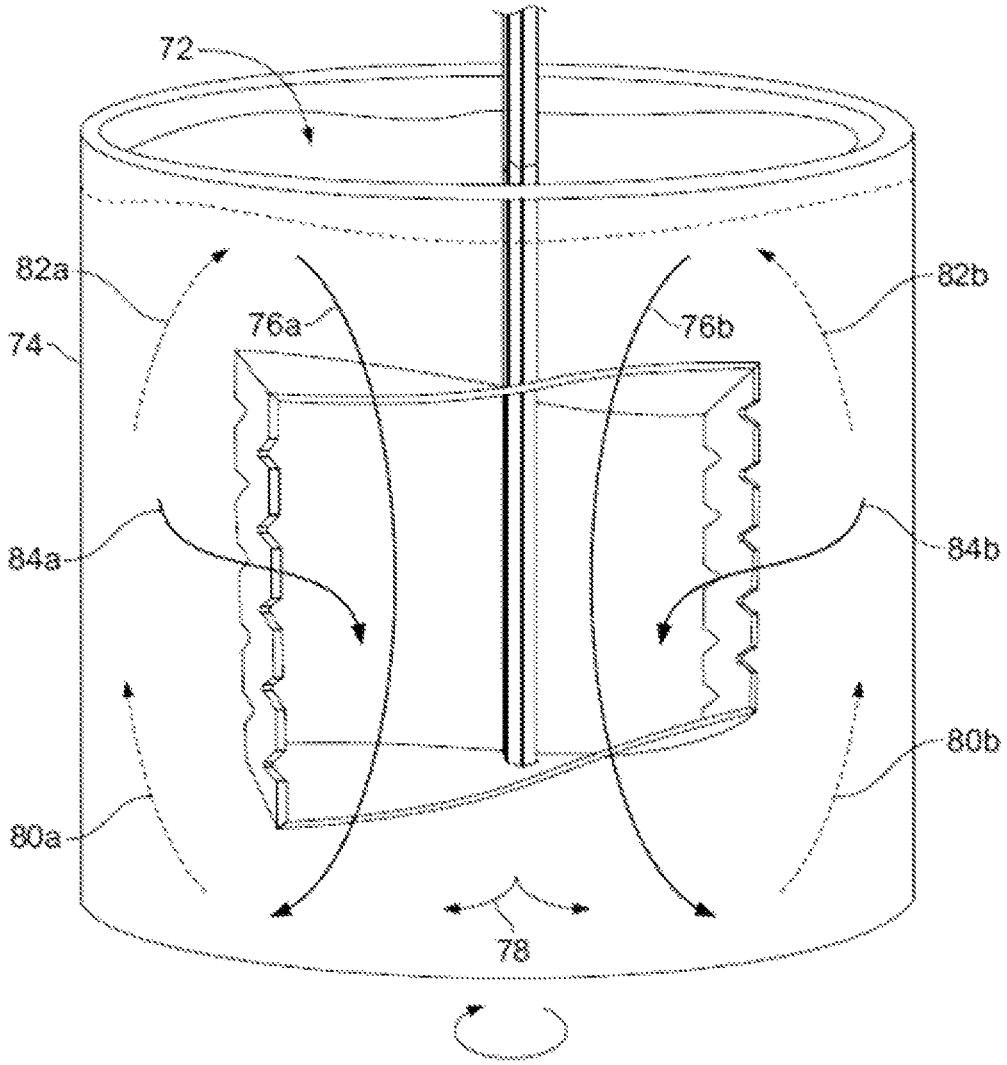
FIG. 6 shown a front view of the invention and cutaway view of a mixing chamber.
Figure 7A:
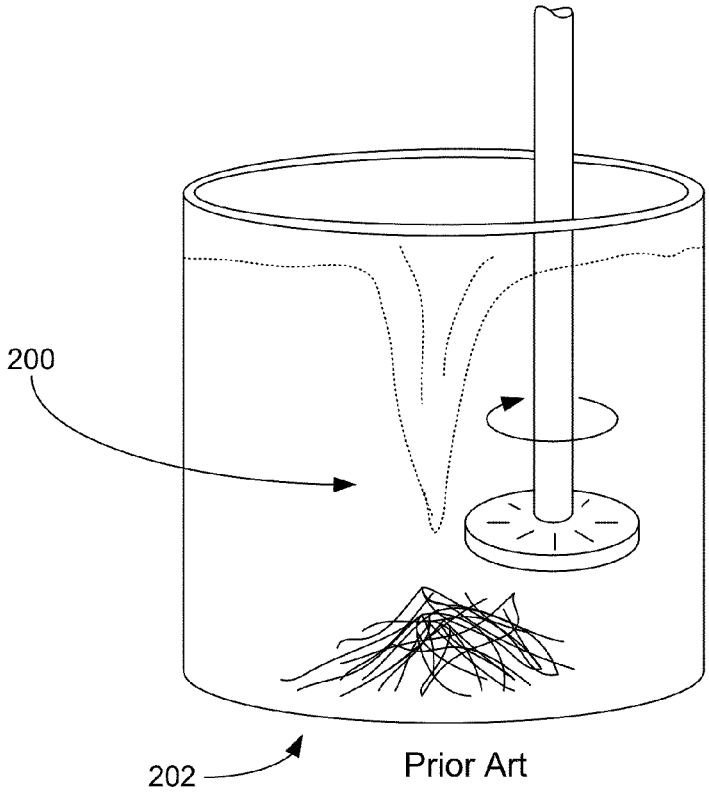
FIGS. 7A through 7D show prior art.
Figure 7B:
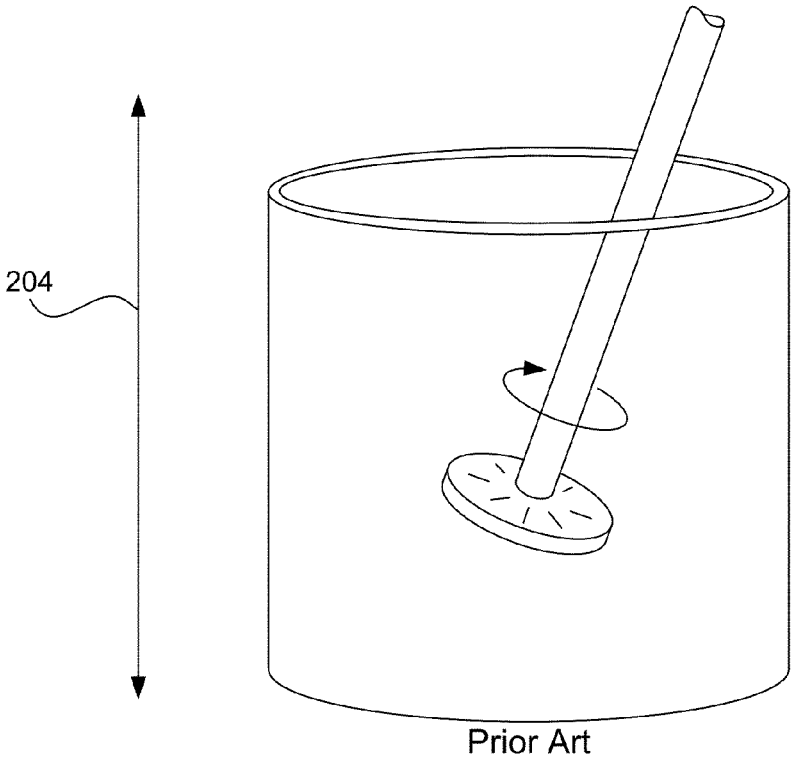
Figure 7C:
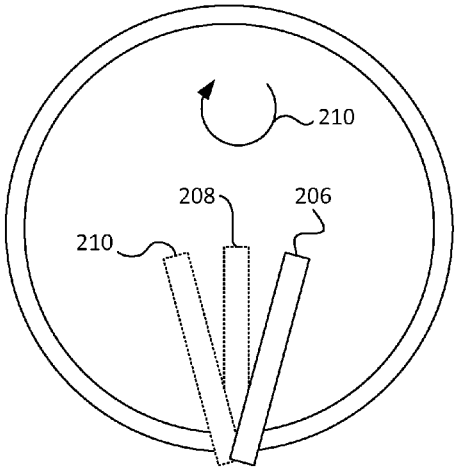
Prior Art Fig 7C
Figure 7D:
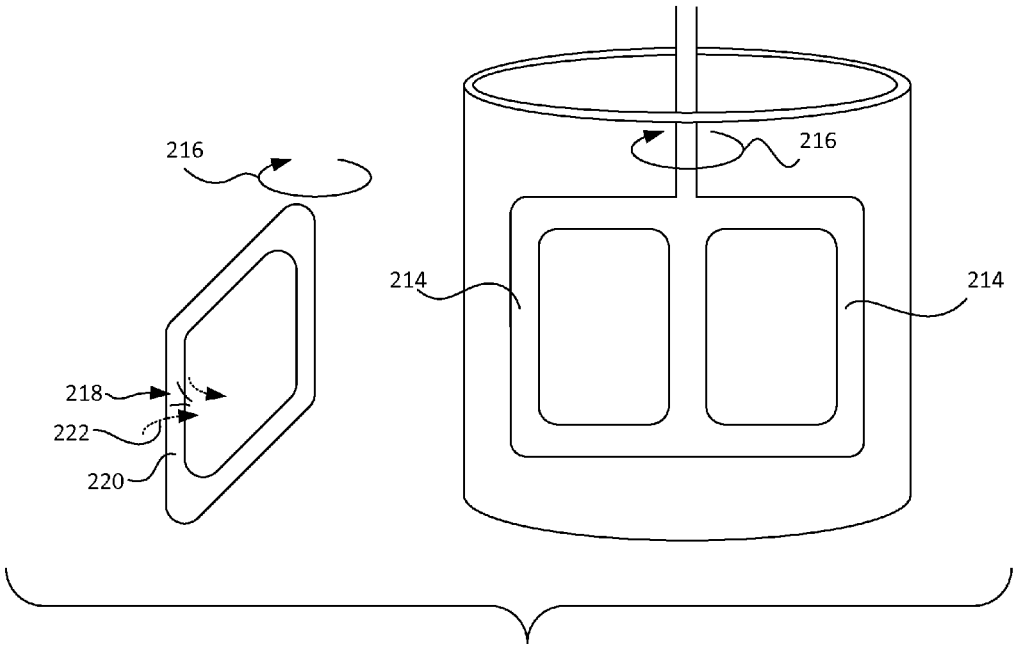
Fig 7D Prior Art

Referring to FIG. 6, the efficiency of the current invention is shown in further detail as the invention rotates in a direction shown as 70. Fluid shown generally as 72 is contained in a mixing chamber or vessel 74. The mixing head 12 is received by the container and immersed into the fluid (or powder). The rotation of the mixing head creates a downward flow shown a 76*a* and 76*b*. These flows force liquid to the bottom which draws liquid from the bottom is directions 78. The flows cause liquid, after contacting the bottom, to flow upwards in directions shown as 80*a* and 80*b*. This causes the flow to rise to the top of the liquid shown as 82*a* and 82*b*. Additionally, the standards, especially offset standards, cause liquid to flow along paths 84*a* and 84*b*. The cooperation of these flows causes the contents of the mixing container to evenly mix, without creating a vortex and allowing material located at the bottom of the container to evenly mix.

Further, eliminating the vortex is not the only benefit of the current invention. The cooperation of the fluid flows significantly reduces formation of voids in the liquid due to cavitations. Therefore, the present invention results in far fewer bubbles formed in the paint than the prior art resulting in a significantly resulting mixture. This is advantageous not only to paint for a smooth surface, but also for applications such as mixing concrete.

While a preferred embodiment of the invention has been described using specific terms, such description is for illustrative purposes only, and it is to be understood that changes and variations may be made without departing from the spirit or scope of the following claims.

What is claimed is:

1. A stirring apparatus comprising:

a plurality of top blades having between a 5° to 180° offset twist between them attached perpendicularly to a shaft so that a downward fluid flow is created when said shaft is rotated by a rotary drive;

a concave surface included in each top blade;

a plurality of bottom blades having between a 5° to 180° offset twist between them attached perpendicularly to said shaft;

a convex surface included in each bottom blade; and, a plurality of standards attached to said plurality of top blades and said plurality of bottom blades separating said plurality of blades and arranged parallel to said shaft so that an inward fluid flow is created when said shaft is rotated.

2. The apparatus of claim 1 wherein a first of said top blades and a second of said top blades form a top blade assembly having a twist of about 60° along said top blade assembly.

3. The apparatus of claim 1 including a serrated edge along a leading edge of at least one of said standards.

4. The apparatus of claim 1 including a serrated edge along a trailing edge of at least one of said standards.

5. The apparatus of claim 1 including:

a mixing vessel for receiving said blades, said standards and a portion of said shaft; and, wherein a length of said blades is at least 50% of the diameter of said mixing vessel.

6. The apparatus of claim 5 wherein said length of said blades are greater than 80% of the diameter of said mixing vessel.

7. The apparatus of claim 1 wherein the length of a leading edge of each said standard is greater than the length of the training edge of each said standard.

8. A stirring apparatus comprising:

a shaft for attaching to a rotary drive;

a first top blade having between 5° and 90° positive twist attached to said shaft generally perpendicular to said shaft and includes a concave surface;

a second top blade having between 5° and 90° negative twist attached to said shaft and 180° to said first top blade;

a first standard carried by a distal end of said first top blade having between a 0° to 25° positive offset to an axis defined along the length of said first top blade wherein the length of a leading edge of said first standard is greater than the length of a trailing edge of said first standard;

a second standard carried by a distal end of said second top blade; and, a bottom blade attached to said first and said second standards.

9. The apparatus of claim 8 wherein said bottom blade has between a 0° to 90° twist along its length.

10. The apparatus of claim 8 include a serrated edge disposed along a leading edge of said first standard.

11. The apparatus of claim 8 including a plurality of right angle recesses in an edge of said standard separated by a portion of said edge.

12. The apparatus of claim 8 wherein a length of said first top blade and said second top blade total about 80% of the diameter of a mixing container receiving the apparatus.

13. A stirring apparatus comprising:

an agitation cavity defined by a top blade having between a 30° and 90° twist along its length, a first and second standard attached to said top blade having an inside offset of between 0° and 25° and a bottom blade having between a 30° and 90° twist along its length;

a concave surface defined in said top blade;

a convex surface defined in said bottom blade; and, a mixing vessel receiving said agitation cavity so that when said shaft is rotated, a downward fluid flow and an inward fluid flow is provided.

14. The apparatus of claim 13 wherein said top blade has a twist of about 60°.

15. The apparatus of claim 13 wherein said first and second standards have an inside offset of about 15°.

16. The apparatus of claim 13 wherein the length of said top blade is greater than about 80% of the diameter of said mixing vessel.

17. The apparatus of claim 13 including a serrated edge along a leading edge of at least one of said standards.

18. The apparatus of claim 13 including a serrated edge along a trailing edge of at least one of said standards.

* * * * *